United States Patent [19]

Dandapani et al.

[11] Patent Number: 4,995,952

[45] Date of Patent: Feb. 26, 1991

[54] ELECTROLYSIS OF WATER USING HYDROGEN SULFIDE

[76] Inventors: Balasubramaniam Dandapani, 2808-700 Dominik Dr.; John O'M. Bockris, Rt. 3, Box 286, both of College Station, Tex. 77840

[21] Appl. No.: 44,068

[22] Filed: Apr. 30, 1987

[51] Int. Cl.[5] ..... C25B 1/04

[52] U.S. Cl. ..... 204/129; 204/101; 204/128

[58] Field of Search ..... 204/129, 128, 292-294, 204/274, 277, 278, 101

[56] References Cited

U.S. PATENT DOCUMENTS

| | | | |
|---|---|---|---|
| 2,839,381 | 6/1958 | Lee | 75/33 |
| 3,409,520 | 11/1968 | Bolmer | 204/101 |
| 4,081,337 | 3/1978 | Spitzer | 204/129 |
| 4,443,423 | 4/1984 | Olson | 204/129 |
| 4,544,461 | 10/1985 | Venkatesan | 204/128 |

OTHER PUBLICATIONS

Dandapani et al., *Proc. Electrochem. Soc., vol. 86. May 1986, pp. 228-237.*

Dandapani et al., *Proc. Intersoc. Energy Convers. Eng. Conf.*, vol. 1, May-1986, pp. 262-265.

Kalina et al., International Journal of Hydrogen Energy, 10:163-167 (1985).

Dandapani et al. paper, Electrochem., Soc. Meeting, Boston, May, 1986.

*Primary Examiner*—John F. Niebling

*Assistant Examiner*—David G. Ryser

*Attorney, Agent, or Firm*—Arnold, White & Durkee

[57] ABSTRACT

Conditions have been found which make possible the continuous electrolysis of water using hydrogen sulfide. Contrary to the previous claims, it is not necessary to add a solvent for sulfur extraction. The invention avoids the difficulty of the passivation of the anode and the interruption of the current flow.

5 Claims, 2 Drawing Sheets

ELECTROLYSIS OF WATER USING HYDROGEN SULFIDE

REFERENCES CITED

U.S. Pat. No. 3,409,520, 11/1968, P. W. Bolmer.

U.S. Pat. No. 4,544,461, 10/1985, S. Venkatesan, N. Plasky and K. Sapru.

BACKGROUND

Electrolytic hydrogen is usually produced by electrolysis of an aqueous solution at an operating voltage of 2.0 V. During this process, oxygen is also produced, making the separation of hydrogen and oxygen necessary. The high operating voltage necessary for the electrolysis of water is due to the high energy needed for breaking the OH bond, which is reasonably strong. Several attempts have been made to reduce the operating voltage of the electrolysis by addition of various anodic depolarizers like coal, biomass, etc., to the eletrolyte.

The chemical bond strength of H-O is 102.3 kcal $mol^{-1}$. In $H_2S$, the bond strength of H-S bond is only 82.3 kcal $mol^{-1}$. Hence, the basic thermodynamically reversible potential for electrolysis of an aqueous solution saturated with $H_2S$ should be less than that of water.

For the overall reaction $$H_2S \rightarrow H_2 + S \quad (1)$$

the standard potential is 0.171 V compared to 1.23 V for the reaction $$H_2O \rightarrow H_2 + \tfrac{1}{2}O_2 \quad (2)$$

The free energy change for the reaction (1) is 7.892 kcal $mol^{-1}$. The energy needed to break the HS bond and produce hydrogen is not high enough to produce oxygen at the anode, and thus avoids any separation in the electrolytic processes. Further, when hydrogen is produced by breaking the HS bond, (elemental) sulfur is produced.

A prior art of hydrogen sulfide removal is disclosed in U.S. Pat. No. 3,409,520. In this, it is suggested that a hydrogen-sulfide-hydrocarbon gas mixture is introduced into the electrolysis cell having an electrolyte operating at room temperature. The gas mixture comes in contact with porous electrodes activated with platinum catalysts. An externally generated current is passed through the cell. The sulfur produced at the anode blocks the reaction, which is subsequently removed by circulating a solvent to reactivate the anode. In this prior art, the cell will lose the efficiency with time due to the poisoning of the catalyst by sulfide ions accumulated in the solution as a result of the continuous dissolution of the hydrogen sulfide gas.

In another prior art disclosed in U.S. Pat. No. 4,544,461, a catalytic anode material is described for hydrogen sulfide decomposition. This again operates at room temperature and uses a solvent for frequent removal of sulfur formed at the anode.

One drawback of the prior art of the electrolytic decomposition of $H_2S$ is the use of catalyst that is normally poisoned by hydrogen sulfide. Unfortunately, the poisoned catalyst will not be effective in further decomposition of $H_2S$ and will consume a larger amount of energy to decompose further amounts of $H_2S$. Since the catalysts used are based on noble metals, the process will be expensive.

A second drawback in both the prior arts described here is the use of a special solvent for removal of deposited sulfur from the anode. This hampers the continuous operation of the cell, reduces the efficiency of the electrolytic process (with gradual build-up of sulfur at the anode) and possible contamination of the electrolyte with the solvent used for removing deposited sulfur.

The serious drawbacks of the earlier inventions have been completely eliminated in the invention disclosed here.

SUMMARY OF THE INVENTION

In accordance with the present invention, the disadvantages of the prior art technology for electrolyzing water using hydrogen sulfide are eliminated by establishing conditions for continuous dissolution of the sulfur product formed at the anode.

In one aspect of the present invention, the electrolysis of water utilizes an electrolytic cell having an electrolyte therein and an anode and cathode which are in contact with the electrolyte heated to a temperature above 65° C. and connected to an external power source. Pure hydrogen sulfide or a gas mixture containing hydrogen sulfide is introduced into the cell in contact with the electrolyte. When the electrolyte is saturated with hydrogen sulfide, it is electrolysed between the cathode and anode to form hydrogen at the cathode and sulfur at the anode.

In another aspect, the present invention involves the use of a nonpassivating electrode at an operating temperature of 80° C. for a continuous electrolysis of water using hydrogen sulfide as a depolarizer. The nonpassivating electrode can be made, for example, of graphite, nickel, iron, cobalt, and alloys thereof, without prior catalytic treatment. An apparatus in accordance with the present invention for electrolysing water using hydrogen sulfide can comprise a means of maintaining the desired operating temperature of the cell, a cathode, an anode, a device to introduce hydrogen sulfide or hydrogen sulfide containing gas for saturating the electrolyte with hydrogen sulfide, an external power source connected to the anode and cathode, and suitable means to withdraw the precipitated sulfur during the course of the electrolysis. The electrolysis of water in the cell can be conducted at 80° C. with high faradaic efficiencies close to 90–95% at an operating voltage of 0.4 V and a current density of 100 mA $cm^{-2}$ in an alkaline electrolyte of concentration from 1.0M to 10M containing hydrogen sulfide at concentrations ranging from 1.0M to the saturation limit at a pH of 8.5 to 9.5. The electrolyte can be an aqueous solution of an alkali, containing sodium and/or potassium ions. The hydrogen and sulfur produced in the process are of high purity and are not mixed with oxygen or any other impurity.

The present invention provides a process for continuous electrolysis of water with hydrogen sulfide as a depolarizer where the production efficiencies of hydrogen and sulfur are very high.

Figure 1:
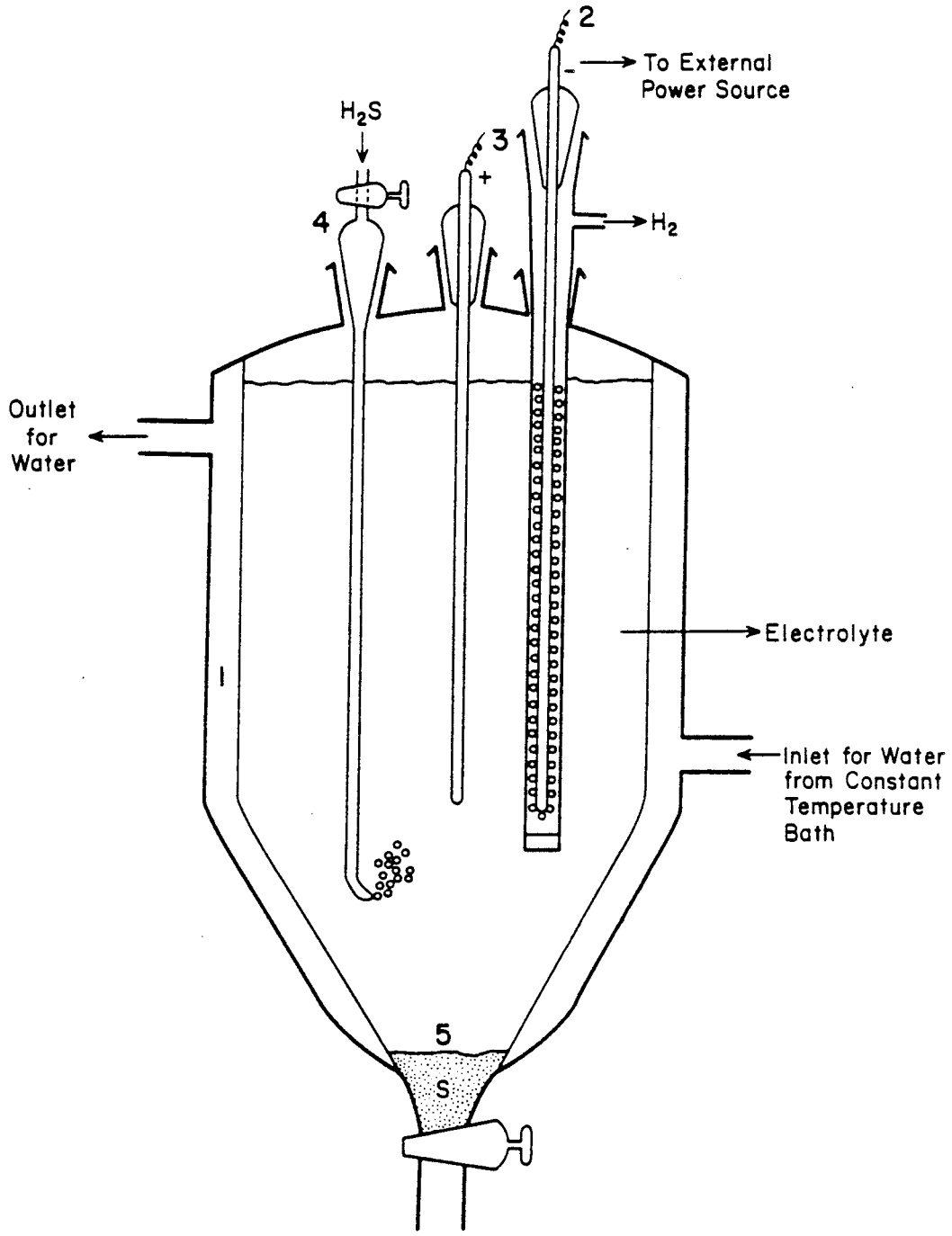
FIG. 1 Diagrammatic sketch of the electrolytic cell used for electrolysis of water using hydrogen sulfide.

In the laboratory process tested with a bench scale device shown in FIG. 1, an alkaline solution at temperatures above 65° C. is saturated with hydrogen sulfide and electrolysed between two nickel or graphite electrodes without any catalyst loading. Vigorous gas evolution is seen only at the cathode. The electrolyte which is light yellow in color to start with turned deeper in yellow color and brownish orange as the electrolysis progressed, indicating spontaneous continuous dissolution of the sulfur formed (at the anode) in the electrolyte. This color development is due to the formation of polysulfides. Hydrogen produced at the cathode is collected in the pure form. Sulfur recovery is done by continuous electrolysis to precipitate sulfur out from the saturated polysulfides in solution. Sulfur recovery does not need any additional solvent or any interruption in the electrolysis to extract it.

The pH of 1.0M alkali when saturated with $H_2S$ is around 8.5 and that of 6.0M alkali is around 9–9.5. The pH of the electrolyte is kept constant by replenishing it with $H_2S$, thus making $H_2S$ as the sole consumable chemical. This makes the said process economically advantageous for removal of hydrogen sulfide from sour gas (natural gas mixed with $H_2S$). The said process has the additional economic value of the hydrogen and sulfur produced, as a by-product of the clean-up. The net cost of removal of $H_2S$ from gas streams is negative.

EXAMPLE

Figure 2:
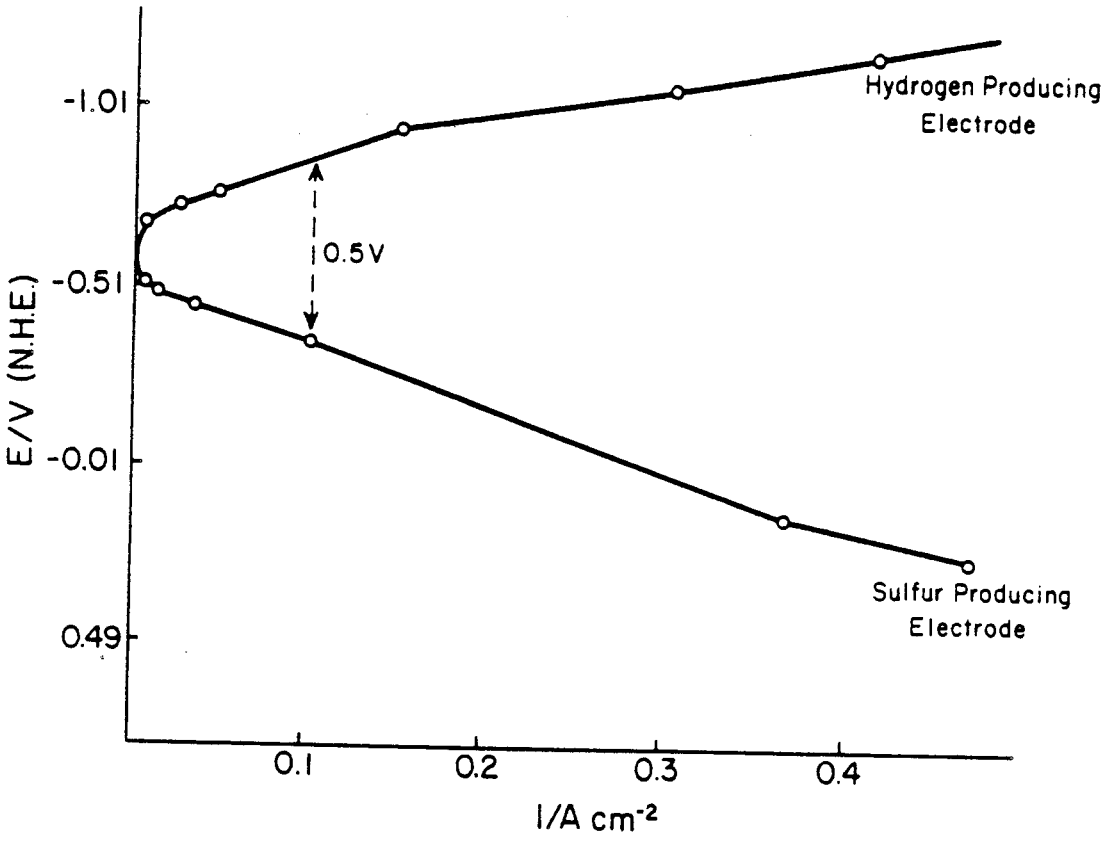
FIG. 2 Current-voltage characteristics of a graphite electrode in 6.0M NaOH (at 80° C.) saturated with $H_2S$.

An electrolyte of 6.0M NaOH is heated to 80° C. in a thermostated cell described in FIG. 1 and saturated with hydrogen sulfide by passing hydrogen sulfide gas for 8–10 hours. The $H_2S$-saturated electrolyte is electrolysed with nickel or graphite electrodes as a cathode and an anode without any catalytic treatment. The current-potential characteristics of graphite electrodes is indicated in FIG. 2.

EXAMPLE 2

The electrolyte is saturated as described in Example 1 and an electrolysis was conducted with an external power source at 0.4 V and 100 mA $cm^{-2}$ for 21 days using graphite electrodes (as anode and cathode). The efficiency of sulfur production and hydrogen production was monitored and found to be between 90% and 95%.

What is claimed is:

1. An electrolytic process, comprising electrolyzing hydrogen sulfide in an aqueous alkaline solution at a temperature above about 65° C., the solution having an alkali concentration of between about 1M and about 6M, the solution being substantially free of organic solvents, the electrolysis being performed by contacting the solution with an anode and a cathode and connecting the anode and the cathode to an external power source; whereby substantially pure hydrogen gas is generated continuously at the cathode; whereby sulfur is generated continuously at the anode without substantially passivating the anode, the sulfur being spontaneously dissolved in the solution as polysulfide and ultimately precipitating in the form of substantially pure sulfur; and whereby substantially no gaseous oxygen is generated at the anode.

2. The process of claim 1, where hydrogen sulfide is added to the solution as needed to maintain the solution's pH substantially constant.

3. The process of claim 1, where the anode and cathode are made from materials selected from the group consisting of graphite, nickel, iron, cobalt, and alloys thereof.

4. The process of claim 1, where a current density of about 100 mA $cm^{-2}$ is obtained in the aqueous solution.

5. The process of claim 1, where the pH of the solution after it is substantially saturated with hydrogen sulfide is between about 8.5 and about 9.5.

* * * * *

UNITED STATES PATENT AND TRADEMARK OFFICE

CERTIFICATE OF CORRECTION

PATENT NO. : 4,995,952

DATED : Feb. 26, 1991

INVENTOR(S) : Dandapani, et al.

It is certified that error appears in the above-identified patent and that said Letters Patent is hereby corrected as shown below:

In claim 1, at column 4, line 17, the word "an" should be deleted and --a nonporous-- should be substituted in its place.

In that same line the word "a" that appears immediately before "cathode" should be deleted.

Signed and Sealed this

Eleventh Day of August, 1992

*Attest:*

DOUGLAS B. COMER

*Attesting Officer*

*Acting Commissioner of Patents and Trademarks*